US006813914B2

(12) United States Patent
Chen

(10) Patent No.: US 6,813,914 B2
(45) Date of Patent: Nov. 9, 2004

(54) PROTECTIVE MECHANISM FOR PADLOCK

(76) Inventor: Min-Hui Chen, 2F, No. 4, Alley 8, Lane 303, Nanching E. Rd., Sec. 3, Taipei (TW)

( * ) Notice: Subject to any disclaimer, the term of this patent is extended or adjusted under 35 U.S.C. 154(b) by 0 days.

(21) Appl. No.: 10/644,826

(22) Filed: Aug. 21, 2003

(65) Prior Publication Data

US 2004/0055342 A1 Mar. 25, 2004

(30) Foreign Application Priority Data

Sep. 23, 2002 (TW) ..... 91214998 U

(51) Int. Cl.[7] ..... E05B 17/14; E05B 67/38

(52) U.S. Cl. ..... 70/50; 70/52; 70/55; 70/423; 70/455

(58) Field of Search ..... 70/50–56, 423–428, 70/455, DIG. 43, DIG. 56

(56) References Cited

U.S. PATENT DOCUMENTS

| | | | | | |
|---|---|---|---|---|---|
| 1,369,506 | A | * | 2/1921 | Voight | 70/455 |
| 2,375,488 | A | * | 5/1945 | Olson | 70/38 A |
| 2,904,985 | A | * | 9/1959 | Murphy | 70/51 |
| 3,983,725 | A | * | 10/1976 | Manuel et al. | 70/55 |
| 4,218,902 | A | * | 8/1980 | Druschel | 70/55 |
| 4,224,813 | A | * | 9/1980 | Hampton | 70/51 |
| 4,226,100 | A | * | 10/1980 | Hampton et al. | 70/51 |
| 4,286,445 | A | * | 9/1981 | Sills | 70/55 |
| 4,297,861 | A | * | 11/1981 | Dykes | 70/55 |
| 4,317,344 | A | * | 3/1982 | Barnard | 70/55 |
| 4,651,543 | A | * | 3/1987 | Heald et al. | 70/54 |
| 4,799,565 | A | * | 1/1989 | Handa et al. | 180/69.4 |
| 4,905,486 | A | * | 3/1990 | Appelbaum | 70/54 |
| 5,033,279 | A | * | 7/1991 | Lebrecht | 70/55 |
| 5,156,029 | A | * | 10/1992 | Heald | 70/55 |
| 5,241,846 | A | * | 9/1993 | Hoke | 70/455 |
| 5,761,935 | A | * | 6/1998 | Adelmeyer | 70/55 |
| 5,921,115 | A | * | 7/1999 | Winner | 70/18 |
| 6,467,316 | B1 | * | 10/2002 | Chen | 70/56 |

FOREIGN PATENT DOCUMENTS

| | | | | |
|---|---|---|---|---|
| AT | 154804 | * | 10/1938 | 70/55 |

* cited by examiner

*Primary Examiner*—Lloyd A. Gall
(74) *Attorney, Agent, or Firm*—Bacon & Thomas, PLLC

(57) ABSTRACT

A protective device for a padlock. The device includes a casing having a connecting member at either top or bottom, a cover formed at the top of the casing and a base formed at the bottom of the casing being connected to the top and bottom of the connecting member by soldering respectively, so that the casing, the cover and the base are adapted to enclose a body of the padlock. The base includes an opening having an annular downwardly extended flange for receiving a keyhole of the padlock, and an extension member having a recessed enlargement at one open end for being hingedly coupled to one side of the base, so that a pivotal movement of the extension member toward the base will snap the enlargement into and seal the opening.

11 Claims, 5 Drawing Sheets

PROTECTIVE MECHANISM FOR PADLOCK

FIELD OF THE INVENTION

The present invention relates to padlocks and more particularly to a protective mechanism for such a padlock with improved characteristics.

BACKGROUND OF THE INVENTION

Conventionally, a padlock comprises a body having an interior lock core. There are a plurality of apertures in the lock core. Spring, detent, or the like are mounted in the apertures. One end of the lock core is formed as a keyhole at one end (e.g., bottom) of the body so that a key can be inserted into the keyhole and the other end thereof is formed as a bent link at the other end (e.g., top) of the body. The link is pivotal about the body. A hole is formed on the top of the body for permitting an open end of the link to be inserted into. In a case of inserting a key into the keyhole and rotating the key, the spring in the aperture will expand to push the detent downward to urge against the lock core for temporarily holding the lock core. Next, a further rotation of the key will push the detent to a predetermined position to allow the lock core to rotate. As a result, the link is free to pivot.

However, the prior art padlock suffered from a disadvantage. For example, a useful life of the padlock is relatively short due to exposure to wind, rain, and other adverse factors when it is used in an outdoor environment. In detail, the keyhole, the top hole, and a pivot point of the link on the top of the body are either completely or partially open, resulting in an easy permeation of rain into the interior of the body therethrough. Hence, components inside the body tend to get rust as time evolves. This can malfunction one or more components of the padlock. To the worse, the lock core may be stuck (i.e., impossible of rotating) if the rust is serious.

Referring to FIG. 1, a padlock having a protective mechanism against rain (i.e., rainproof mechanism) is devised by a padlock manufacturer in recent years. In detail, the protective mechanism consists of a protective casing 3 and a protective covering 4 covered around the body 1 of the padlock and the link 2 respectively in which both the protective casing 3 and the protective covering 4 are formed of plastic materials (e.g., epoxy). The protective casing 3 comprises a sheath 30 sleeved around the body 1, a cover 32, and a base 34. A connecting member 36 comprising a plurality of alternate recesses and risers is formed at either top edge or bottom edge of the sheath 30. Two ends (i.e., upper and lower ends) of the sheath 30 are enclosed by the cover 32 and the base 34 respectively. Two holes 320 are formed on the cover 32 in which the link 2 passes one hole 320 (e.g., the right hole on the cover 32) and the open end of the link 2 is adapted to insert into the other hole 320 (e.g., the left hole on the cover 32). A cylindrical opening 340 is formed on the base 34. An extension member 342 is hingedly coupled to one side of the base 34. A cylindrical tab 344 is projected from an internal side of the base 34. The tab 344 is adapted to insert into the opening 340 for sealing the opening 340 when the extension member 342 is pivoted toward the opening 340 to engage with the base 34. After the sheath 30, the cover 32, and the base 34 have been assembled on the body 1, the connecting members 36, the cover 32, and the base 34 can be formed together by soldering. At this moment, the keyhole 10 is disposed in the opening 340. Two enlargements 40 are formed at both ends of the bent protective covering 4. The enlargements 40 are pressed on the cover 32 when the link 2 is pressed down to insert its open end into the hole 320. As a result, both holes 320 are sealed. It is reasonably to believe that rain will not permeate into the body 1 through the opening 340, the connecting members 36, and the holes 320.

However, the padlock having the provision of both the protective casing 3 and the protective covering 4 is still susceptible of rain permeation after being used in an outdoor environment for a short period of time. As an end, the padlock is malfunctioned. Most rain comes into the body 1 through the holes 320 as we detach the body 1 for further examination. In fact, the enlargements 40 of the protective covering 4 are compromised in preventing rain from passing into the body 1. Also, rust is found in the surface of the body 1. Such rust is caused by rain passing into gaps between the body 1 and the protective casing 3 through portions between the sheath 30 and the cover 32 and between the sheath 30 and the base 34 not provided with the connecting members 36 which, as stated above, are coupled between the sheath 30 and the cover 32 and between the sheath 30 and the base 34 respectively. In brief, the protective casing 3 and the protective covering 4 are useless in view of their design purposes. Hence, a need for improvement exists.

SUMMARY OF THE INVENTION

A primary object of the present invention is to provide a protective mechanism for a padlock. The protective mechanism comprises a casing for enclosing a body of the padlock, the casing including a connecting member at either top or bottom; a cover formed at the top of the casing for being connected to the top connecting member by soldering, the cover comprising two spaced holes; and a base formed at the bottom of the casing for being connected to the bottom connecting member by soldering so that the cover, the base, and the casing are adapted to enclose the body, the base comprising an opening having an annular, downwardly extended flange for receiving a keyhole of the padlock, and an extension member hingedly coupled to one side of the base, the extension member including a recessed enlargement at one open end so that a pivotal movement of the extension member toward the base will snap the enlargement into and seal the opening; and two flexible sleeves disposed in the holes wherein a bent link of the padlock is fastened by the sleeves when the link is locked in the holes and two top second holes of the padlock. The protective mechanism ensures that no rain will permeate the body, thereby preventing components inside the body from getting rusted. Moreover, by utilizing the present invention, the well-known drawback of failing to stop rain from permeating the body can be overcome.

The above and other objects, features and advantages of the present invention will become apparent from the following detailed description taken with the accompanying drawings.

DETAILED DESCRIPTION OF THE PREFERRED EMBODIMENTS

Figure 1:
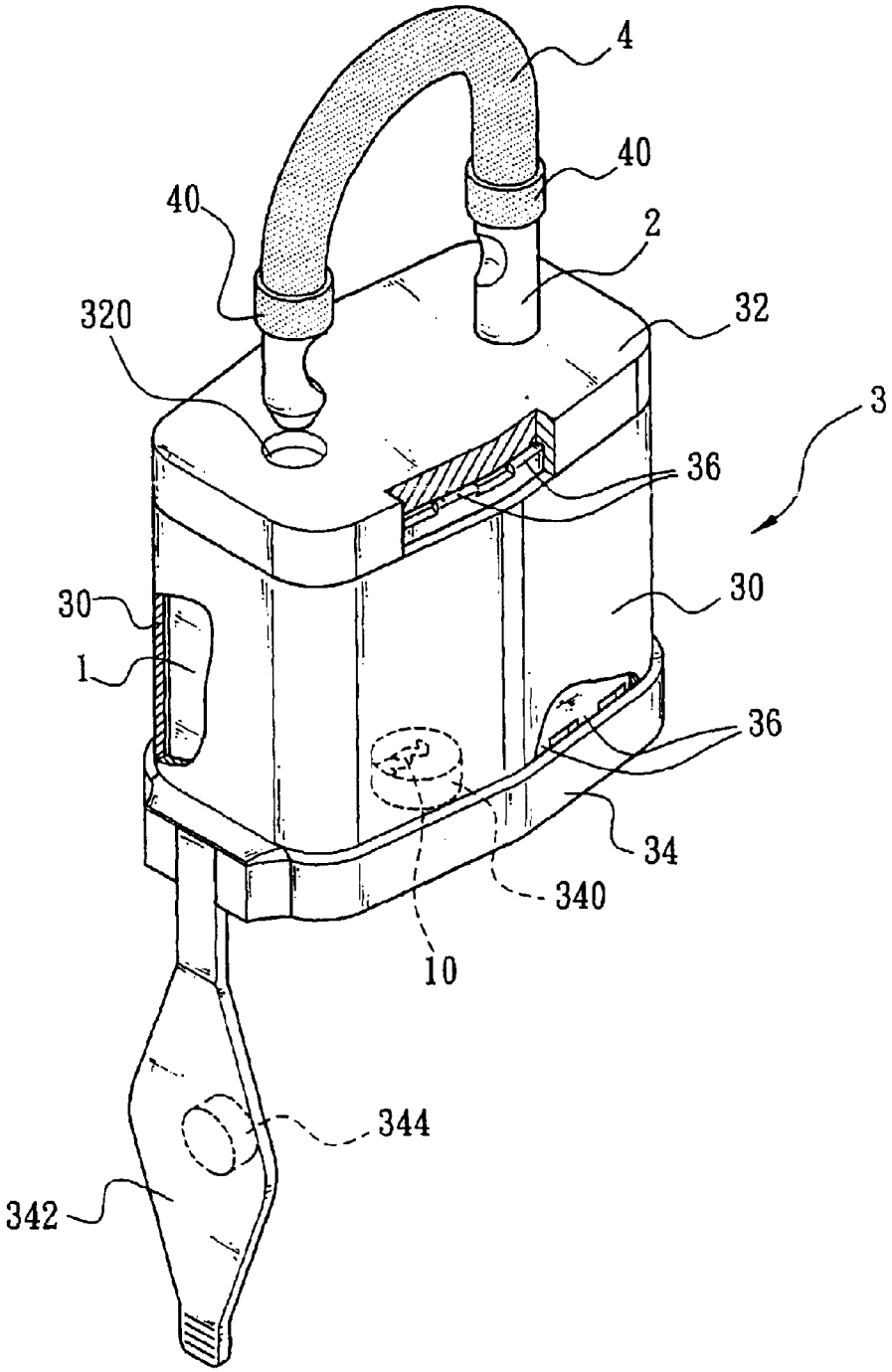
FIG. 1 (Prior Art)
FIG. 1 schematically shows a perspective view of a padlock having a conventional protective mechanism.
Figure 2:
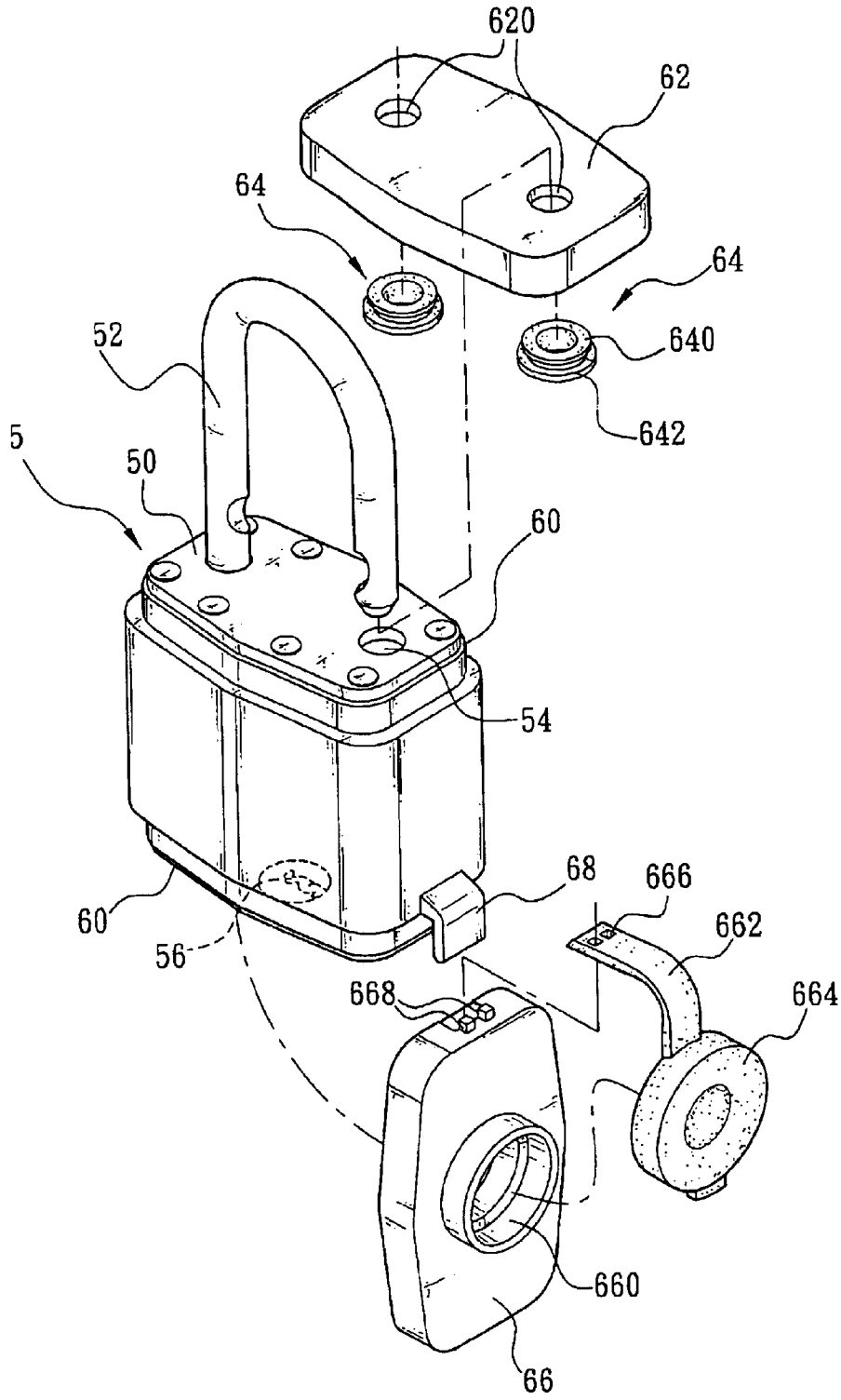
FIG. 2 is an exploded perspective view of a padlock having a protective mechanism according to the invention.
Figure 3:
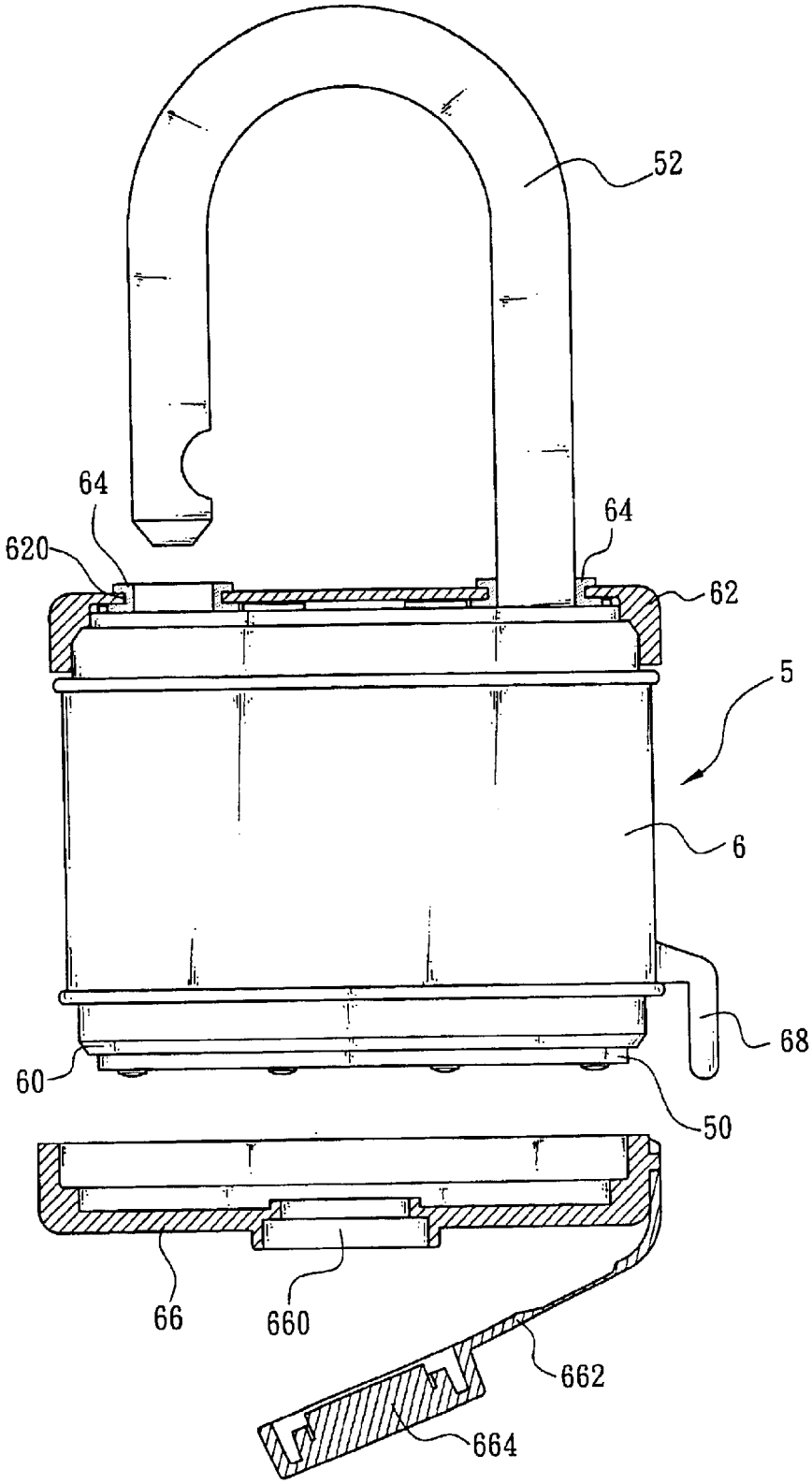
FIG. 3 schematically shows a side plan view in part section of the padlock with the base and the extension member separated.

Referring to FIGS. 2 and 3, a protective mechanism for a padlock 5 in accordance with the invention is shown. A body 50 of the padlock 5 is enclosed by a casing 6 of the mechanism. The casing 6 comprises a connecting member 60 at either top or bottom. A substantially rectangular cover 62 comprises two spaced holes 620. Two flexible sleeves 64 formed of plastic materials are fastened in the holes 620 as detailed later. A substantially rectangular base 66 comprises an opening 660 having an annular, downwardly extended flange, and an extension member 662 hingedly coupled to one side of the base 66 as detailed later. The extension member 662 comprises a recessed enlargement 664 at one open end. The casing 6, the cover 62, and the base 66 can be assembled around the body 50 for being connected the connecting members 60 to the cover 62 and the base 66 respectively by soldering. As an end, the body 50 is enclosed. Also, a bent link 52 is formed at the top of the body 50. The link 52 is pivotal about the body 50 at one hole 54 of the padlock 5 and is adapted to insert into the other hole 54 of the padlock 5. In a case of the open end of the link 52 is inserted into the other hole 54 of the padlock 5, a gap between the link 52 and either hole 54 is sealed by either sleeve 64. Further, a keyhole 56 of the padlock 5 is disposed in the opening 660. Next, pivot the extension member 662 toward the opening 660 to snap the enlargement 664 into the opening 660 for sealing. In configuring as above, it is ensured that no rain will permeate the body 50. As an end, it can prevent components inside the body 50 from getting rusted.

Referring to FIG. 2, in a preferred embodiment of the invention, each sleeve 64 comprises an upper annular, external flange 640 proximate the cover 62. The upper flanges 640 will urge against the cover 62 for fastening the sleeves 64 in the holes 620 after the open end of the link 52 has inserted into the other hole 54. Thus, the sleeves 64 will not move toward the body 50 as the link 52 moves. Alternatively, in the embodiment the sleeve 64 comprises a lower annular, external flange 642 distal from the cover 62 rather than the upper flange 640. Also, the lower flanges 642 will urge against the cover 62 for fastening the sleeves 64 in the holes 620 after the open end of the link 52 has inserted into the other hole 54. Thus, the sleeves 64 will not move toward the body 50 as the link 52 moves. Note that both the upper and the lower flanges 640 and 642 can be formed on the sleeve 64 at the same time so that the sleeve 64 can be served as a well-known sealing ring. As a result, the link 52 will not displace from the cover 62 when the link 52 either fastens in the holes 54 or clear from the same.

Figure 7:
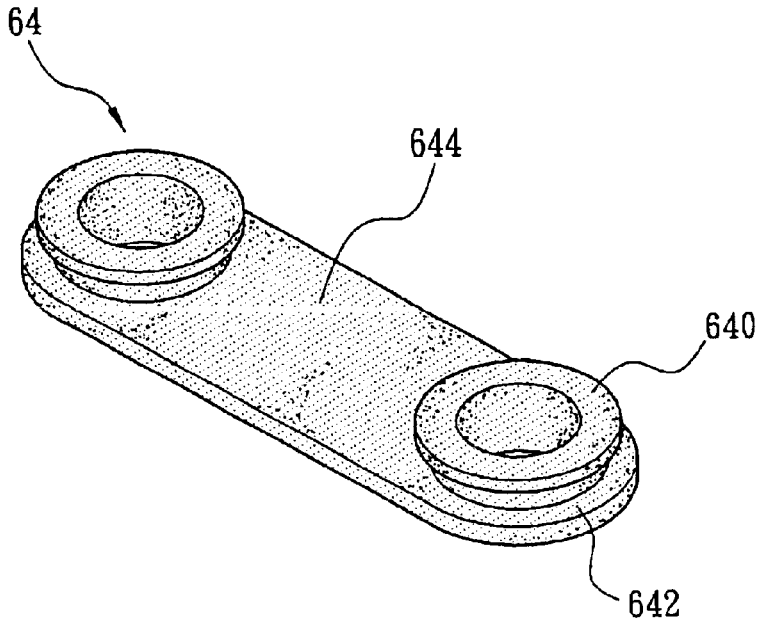
FIG. 7 is a perspective view of a fourth variant of the sleeve.

Referring to FIG. 7 in conjunction with FIG. 2, in a fourth variant of the sleeve 64 a connecting plate 644 is formed to connect two lower flanges 642 together. The connecting plate 644 is tightly fitted under the cover 62. As such, the sleeves 64 will not move toward the body 50 as the link 52 moves while the link 52 is disengaging from the other hole 54 due to the lower flanges 642 and the connecting plate 644 are urged under the cover 62.

Referring to FIGS. 2 and 3 again, in another preferred embodiment of the invention the casing 6 further comprises a bent section 68 downwardly extended from a bottom side of the body 50 toward the extension member 662 to partially lap over the extension member 662. The bent section 68 is served as protection of the extension member 662 fastened at the base 66. As an end, a useful life of the extension member 662 can be prolonged. In the embodiment, the extension member 662 further comprises at least one aperture (two are shown) 666 at the other end. Correspondingly, the base 66 further comprises at least one tab (two are shown) 668. The extension member 662 and the base 66 can be secured together by snapping the tabs 668 into the apertures 666.

Figure 4:
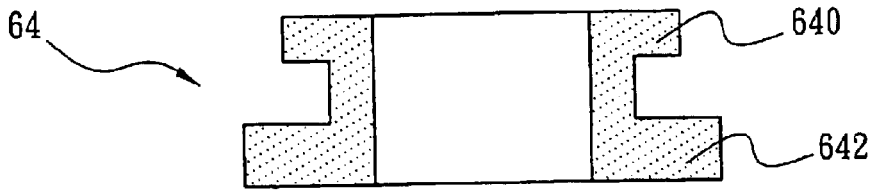
FIGS. 4, 5, and 6 are cross-sectional views of first, second, and third variants of the sleeve respectively.
Figure 5:
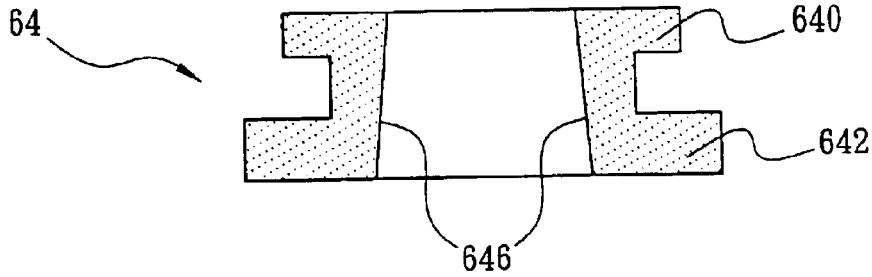
Figure 6:
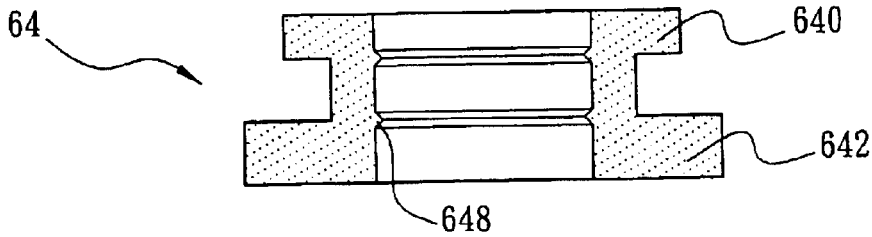

Referring to FIGS. 4, 5, and 6 in conjunction with FIGS. 2 and 3, first, second, and third variants of the sleeve 64 are shown. In the first variant shown in FIG. 4, an inner diameter of the sleeve 64 is smaller than an outer diameter of the link 52. In the second variant shown in FIG. 5, the bore of the sleeve 64 is increased gradually from the top above the cover 62 toward the bottom under the cover 62. Thus, a conic inner surface 646 is formed around the bore of the sleeve 64. Further, an inner diameter of the conic inner surface 646 at its top proximate the top of the cover 62 can be smaller than the outer diameter of the link 52. As such, the sleeve 64 can drive out moisture, dust, or other foreign objects on the link 52 out of the cover 62 by means of the top of the sleeve 64 proximate the cover 62 while the link 52 is being inserted into the holes 54. The third variant shown in FIG. 6 is substantially the same as that of the first variant except the following. Upper and lower annular tapered projections 648 are formed around the bore of the sleeve 64. The upper and lower annular tapered projections 648 can drive out moisture, dust, or other foreign objects on the link 52 out of the cover 62 while the link 52 is being inserted into the holes 54. Also, the upper and lower annular tapered projections 648 can fasten the link 52.

By configuring as above, the casing 6, the cover 62, and the base 66 of the protective mechanism can be assembled around the body 50 for being connected the connecting members 60 to the cover 62 and the base 66 respectively. Moreover, the gap between the link 52 and the hole 54 is sealed by the sleeve 64 therebetween, thereby preventing rain or other foreign objects from entering into the body 50 and/or any gap between the protective mechanism and the body 50. As an end, the well-known problem of getting rust inside the padlock in an outdoor environment is solve.

While the invention has been described by means of specific embodiments, numerous modifications and variations could be made thereto by those skilled in the art without departing from the scope and spirit of the invention set forth in the claims.

What is claimed is:

1. A protective mechanism for a padlock, comprising:

a casing for enclosing a body of the padlock, the casing including top and bottom connecting members;

a cover formed at the top of the casing for being connected to the top connecting member by soldering, the cover comprising two spaced holes;

a base formed at the bottom of the casing for being connected to the bottom connecting member by soldering so that the cover, the base, and the casing are adapted to enclose the body of the padlock, the base comprising an opening having an annular, downwardly extended flange for receiving a keyhole of the padlock, and an extension member hingedly coupled to one side of the base, the extension member including a recessed enlargement at one open end so that a pivotal movement of the extension member toward the base will snap the enlargement into and seal the opening; and two flexible sleeves disposed in respective ones of the holes of the cover wherein a bent link of the padlock is sealed by the sleeves when the link is locked in the holes of the cover and two top second holes of the padlock, and the sleeves are secured between the cover and the top connecting member.

2. The protective mechanism of claim 1, wherein each sleeve comprises an upper annular, external flange proximate the cover so that the upper flanges will be urged against the cover for fastening the sleeves for preventing the sleeves from moving toward the body while inserting the link into the hole and the second hole.

3. The protective mechanism of claim 1, wherein each sleeve comprises a lower annular, external flange distal from the cover so that the lower flanges will urge against the cover for fastening the sleeves for preventing the sleeves from moving toward the body while inserting the link into the hole and the second hole.

4. The protective mechanism of claim 1, wherein each sleeve comprises an upper annular, external flange proximate the cover and a lower annular, external flange distal from the cover.

5. The protective mechanism of claim 3, further comprising a connecting plate for connecting the lower flanges together, the connecting plate being tightly fitted under the cover.

6. The protective mechanism of claim 4, further comprising a connecting plate for connecting the lower flanges together, the connecting plate being tightly fitted under the cover.

7. The protective mechanism of claim 1, wherein the casing further comprises a bent section downwardly extended from a bottom side of the body toward the extension member to partially lap over the extension member.

8. The protective mechanism of claim 1, wherein the extension member further comprises at least one aperture opposite the enlargement, and the base further comprises at least one tab so that the extension member and the base are adapted to secure together by snapping the tab into the aperture.

9. The protective mechanism of claim 1, wherein an inner diameter of at least one of the sleeves is smaller than an outer diameter of the link.

10. The protective mechanism of claim 1, wherein a bore of at least one of the sleeves is increased gradually from a top above the cover toward a bottom under the cover so as to form a conic inner surface around the bore of the sleeve, and an inner diameter of the conic inner surface at a top proximate a top of the cover is smaller than the outer diameter of the link.

11. The protective mechanism of claim 1, further comprising an upper annualar tapered projection and a lower annular tapered projection around a bore of at least one of the sleeves.

* * * * *